US005201460A

United States Patent [19]

Caines

[11] Patent Number: 5,201,460

[45] Date of Patent: Apr. 13, 1993

[54] SPILL-RESISTANT DRINKING STRAW

[75] Inventor: R. Scott Caines, Greenville, S.C.

[73] Assignee: Hoechst Celanese Corporation, Somerville, N.J.

[21] Appl. No.: 516,758

[22] Filed: Apr. 30, 1990

[51] Int. Cl.[5] ..... A47G 19/22

[52] U.S. Cl. ..... 229/103.1; 215/1 A; 220/705; 239/33

[58] Field of Search ..... 229/103.1; 215/1 A; 220/90.2, 705; 239/33

[56] References Cited

U.S. PATENT DOCUMENTS

| | | | |
|---|---|---|---|
| 1,735,144 | 11/1929 | Tanner | 239/33 |
| 2,279,396 | 4/1942 | Hanson, Jr. | 215/1 A |
| 2,613,988 | 10/1952 | Jarbeau | 239/33 |
| 2,849,321 | 8/1958 | Lhermitte et al. . | |
| 3,326,695 | 6/1967 | Neuhauser | 239/33 |
| 3,438,527 | 4/1969 | Gamblin, Jr. . | |
| 3,780,944 | 12/1973 | Zubalik | 239/33 |
| 3,799,914 | 3/1974 | Schmit et al. | 215/1 A |
| 4,134,494 | 1/1979 | Wong . | |
| 4,291,814 | 9/1981 | Conn . | |
| 4,441,640 | 4/1984 | Lottick . | |
| 4,537,324 | 8/1985 | Wang . | |
| 4,591,091 | 5/1986 | Wise | 229/103.1 |
| 4,714,173 | 12/1987 | Ruiz . | |
| 4,792,083 | 12/1988 | Yassur | 229/103.1 |

FOREIGN PATENT DOCUMENTS

| | | | |
|---|---|---|---|
| 464569 | 4/1950 | Canada . | |
| 58787 | 6/1941 | Denmark | 215/1 A |
| 0213673 | 3/1987 | European Pat. Off. . | |
| 941992 | 2/1979 | Fed. Rep. of Germany . | |
| 653179 | 5/1951 | United Kingdom | 239/33 |
| 858477 | 1/1961 | United Kingdom . | |
| 1015430 | 12/1965 | United Kingdom . | |

OTHER PUBLICATIONS

Wall Street Journal, May 31, 1989; "Making It Harder For Kids to Spill".

Wall Street Journal; "Two Juice Holders Learn To Share Their Market".

*Primary Examiner*—Gary E. Elkins

*Attorney, Agent, or Firm*—Bell, Seltzer, Park & Gibson

[57] ABSTRACT

The invention provides spill-resistent drinking straws which are normally maintained in a substantially sealed state such that liquid is substantially prevented from flowing through the straw, but which can be manually deformed to an open state for use in drinking in which liquid can readily flow through the straw. A biasing member which is either integrally formed in the straw or attached to the straw maintains the straw in the substantially sealed state and automatically returns the straw from the open state to the substantially sealed state in the absence of external force. In some embodiments of the invention, the straw is constructed such that it is substantially sealed when in a bent condition such that the straw is crimped and thereby substantially sealed. In other embodiments of the invention, the straw is maintained in a substantially sealed position when in a straightened form.

27 Claims, 4 Drawing Sheets

SPILL-RESISTANT DRINKING STRAW

FIELD OF THE INVENTION

The invention relates to a spill-resistant drinking straw. More specifically, the invention relates to a drinking straw which is normally maintained in a closed position but which can be manually moved to an open state for use in drinking.

BACKGROUND OF THE INVENTION

Aseptically packaged juices and other drinks have become popular grocery items in recent years. Typically, aseptically sealed packages are provided as a flexible container in the shape of, for example, a rectangular box or as a flexible pouch. The containers often are provided in combination with a beveled, pointed straw which is used to puncture the seal of the package. If the container is being gripped firmly when the straw punctures the seal, liquid from the container is apt to squirt out of the container and up through the straw. Similarly, when the straw is seated in the container through the seal, squeezing of the container can cause liquid to squirt out of the straw. If the container falls over, liquid will spill out of the container through the straw. Similar problems exist with respect to other types of containers in which a straw is inserted into a container such as a drinking cup through a relatively tightly fitting hole, in, for example, a plastic lid.

Proposals for remedying the problem of liquids squirting from the straws of flexible containers have been directed to strengthening the container walls so that the container is not so easily deformed. This solution would add to the cost of the container. An alternative solution has been the provision of hard plastic cases adapted to fit around the outside of the rectangular box packages. This successfully prevents deformation of the package when it is squeezed. But the plastic shell must be purchased separately by the consumer or provided separately by the manufacturer or retailer of the packaged liquid.

U.S. Pat. No. 3,438,527 to Gamblin, Jr. proposes a solution to the problem of liquid spillage through a straw seated in a container. According to the disclosure of this patent, a drinking straw is provided with a one-way flow valve to normally prevent flow of liquid into the straw. The application of suction interiorly of the straw is said to collapse an elastic member permitting fluid to flow. Termination of the suction is said to permit the elastic member to re-expand and seal the straw. The elastic member is attached to the straw at the entrance end of the straw or is disposed within and completely across the interior of the straw.

U.S. Pat. No. 4,291,814 to Conn discloses a beverage container which includes a built-in straw. According to the proposal of this patent, a container is provided with an internal vertical tube and an external tube or straw which connects to the internal vertical tube. The straw can be used to seal the container by turning, which results in disalignment of portholes in the external and internal tube. Further turning of the external tube aligns the portholes allowing the tube to be used as a drinking straw.

U.S. Pat. No. 4,714,173 to Ruiz proposes a leak proof closure for containers such as plastic or paper cups used primarily in fast food restaurants. A special container lid is provided with an orifice through which a straw can be inserted and the lid also includes an anchorage for engaging the drinking end of the straw. After the straw has been inserted through the orifice, it is bent at a location above the orifice and the drinking end of the straw is engaged with the anchorage member, thereby securing the straw in a bent position and preventing leakage through the straw in the event that the container is knocked over.

These and other known proposals for reducing spillage involve various shortcomings including difficulty of manufacture and/or the necessity for modification of the container or a closure member for the container.

SUMMARY OF THE INVENTION

The invention provides a spill-resistant straw which is inexpensive, readily manufacturable and which can be used with any of various known containers and container-types without requiring container modification. The straw of the invention can prevent or minimize the squirting of liquid upwardly through the straw when the container is squeezed and/or the spillage of liquid out of the container when the container is tipped over. The spill-resistant drinking straw of the invention comprises a tubular straw which is repeatedly deformable to and from a first substantially sealed state and a second open state. A biasing means is provided for biasing the straw in the sealed state and for retracting the straw from the open state to the substantially sealed state. The straw is manually deformable to the open state for use in drinking and is automatically returned to the closed state by the biasing means in the absence of external force. The biasing means which automatically retracts the straw from the open state to the sealed state can be integrally formed in the straw or can be provided as an attachment to the straw.

In one preferred embodiment of the invention, the spill-resistant drinking straw is provided in the form of a drinking straw which is repeatably bendable axially at a predetermined bending location along the axis of the straw, to and from a sealed state in which the straw is bent sufficiently to crease and collapse the straw walls at the bending location, thereby sealing the straw. The biasing means is provided at or adjacent the bending location on the straw and maintains the straw in the bent and sealed state. The straw can be manually straightened by the user sufficiently that the collapsed crease at the bend of the straw opens up to thereby allow liquid to pass through the straw. The biasing means automatically retracts the straw to the bent, sealed state in the absence of external force. Preferably the bending location is in the half of the straw nearest its mouth end. The biasing means can be provided integrally within the straw or can be provided as an attachment to the straw.

In another preferred embodiment, the spill-resistant drinking straw according to the invention is provided by a drinking straw having an open mouth and a sealed beveled bottom end terminating at a point on one side of the periphery of the straw. A transverse, partial cut extends through a major portion of the straw at a location in the bottom half of the straw axially displaced from and transversely opposite of the terminating point on the bottom of the straw. When the bottom of the straw is placed against a solid surface, such as the bottom of a drinking container, and pressure applied downwardly from the top portion of the straw, the straw bends and opens at the partial cut through the straw. In this open state, the straw can be used for drinking.

When manual force is removed from the straw, the resiliency of the uncut straw wall axially coincident the partial transverse cut in the straw, unbends the straw thereby substantially sealing the partial cut through the straw.

The invention also provides spill-resistant drink products which include the spill-resistant straw of the invention removably attached to a sealed container of liquid. Advantageously the container includes a puncturable seal adapted to provide an orifice of predetermined size and the diameter of the straw is substantially the same as that of the orifice. In other embodiments, the invention provides methods for the manufacture of the spill-resistant straws.

In any of the various spill-resistant straw embodiments of the invention, the straw is maintained in a substantially sealed state in its normal and relaxed condition. In this substantially sealed, normal condition, the straw can be used to puncture the opening of a sealed container and because the straw is sealed, liquid is prevented from squirting upwardly through the straw. Once the straw has been inserted into the container, pressure on the side of the container will not cause liquid to squirt out of the straw because the biasing means normally maintains the straw in its closed state. Similarly, once the straw is seated in the container, falling over of the container will not normally result in leakage through the straw because the straw is in its closed state.

BRIEF DESCRIPTION OF THE DRAWINGS

In the drawings which form a portion of the original disclosure of the invention.

DESCRIPTION OF THE PREFERRED EMBODIMENTS

Various preferred embodiments of the invention are described in the following detailed description. It is to be understood however, that the invention is not limited to its preferred embodiments; to the contrary, the invention includes various alternatives, modifications and equivalents within its spirit and scope as will be apparent to the skilled artisan.

Figure 1:
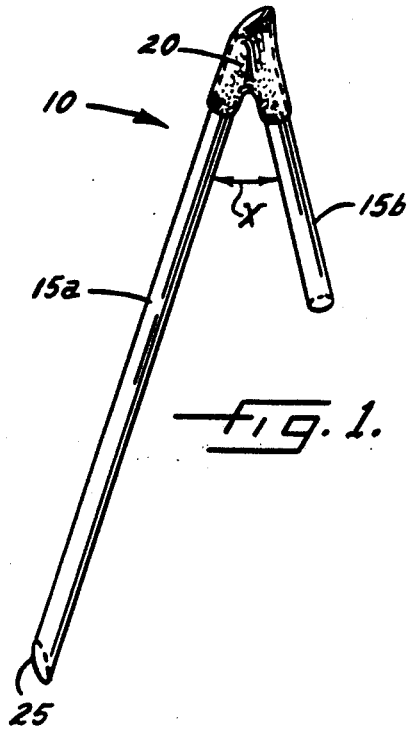
FIG. 1 is a perspective view of one preferred spill-resistant straw of the invention in which an exterior biasing sleeve is provided for retracting and maintaining the straw in a bent and sealed state.
Figure 2:
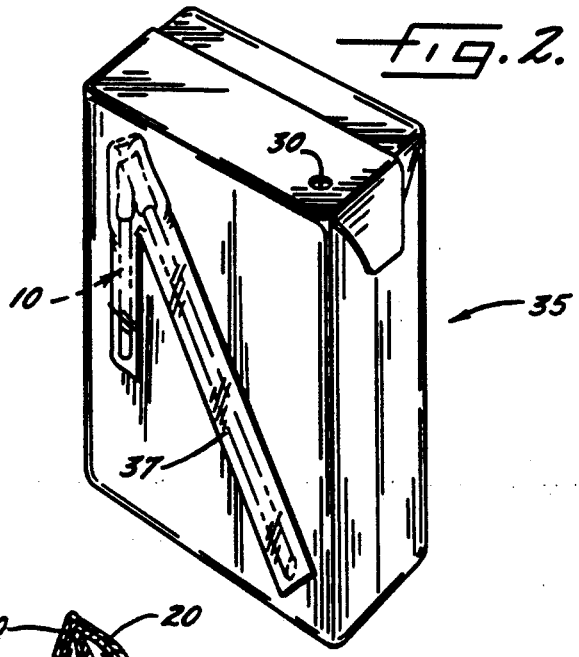
FIG. 2 is a perspective view of a sealed package of liquid provided in combination with the spill-resistant straw of FIG. 1.

FIGS. 1-5 illustrate one preferred spill-resistant drinking straw 10 according to the invention. The spill-resistant straw 10 includes a tubular straw (hereinafter "straw") which is axially bent into portions **15*a* and 15*b* by biasing means 20 and which is normally maintained in the bent and substantially sealed state by biasing means 20. The straw includes a beveled, pointed end 25 which is useful in puncturing a seal of a container, such as the seal 30 of solid rectangular container 35 as shown in FIG. 2. As illustrated in FIG. 2, the spill-resistant straw 10 of the invention can be releasably attached by means of a plastic overwrap or the like 37 to the sealed container 35** so that the consumer is provided with a separate, spill-resistant drinking straw with each container purchased.

Figure 3:
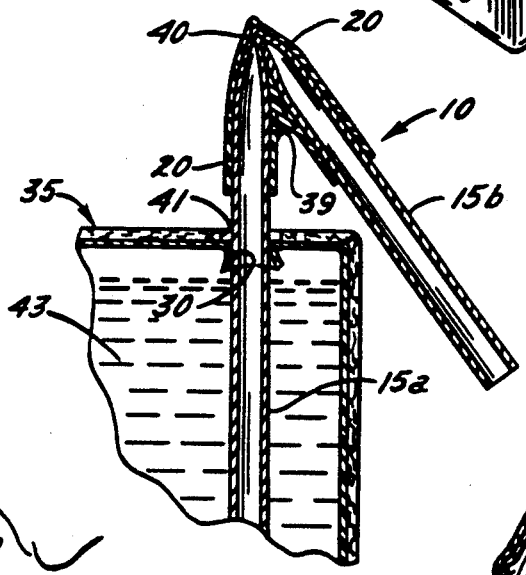
FIG. 3 is a fragmentary cross-sectional view of the straw of FIGS. 1 and 2 when inserted and seated in the container of FIG. 2.

As best shown in FIG. 3, the biasing means 20 maintains the spill-resistant straw 10 in a bent condition so that the tubular walls collapse at the location 40 sufficient to form a crimp or crease in the straw, thereby substantially sealing the tubular straw at location 40.

The biasing means 20 as shown in FIGS. 1-5 is provided in the form of a sleeve of a resilient and flexible plastic material surrounding a portion of the periphery of the straw. The plastic material making up sleeve 20 can be a natural or synthetic rubber or the like and advantageously includes a flap 39 below the bend in the straw. Flap 39 is integrally formed between the two sides of the rubber sleeve 20 and functions to maintain the sleeve 20, and thus the spill-resistant straw 10, in the bent and substantially sealed position illustrated in FIG. 3.

When maintained in the substantially sealed state shown in FIGS. 1-3, the spill-resistant drinking straw 10 substantially eliminates spillage from a liquid container such as container 35. Thus, chisel point bottom end 25 of straw 1 can be used to puncture seal 30 of container 35 without causing liquid in container 35 to squirt upwardly through straw 10. Similarly, once straw 10 is seated within a relatively snug or tight orifice, such as orifice 41 resulting from puncture of seal 30, spillage of liquid 43 out of container 35 is prevented or minimized. Thus, the container having a seated spill-resistant straw 10 as illustrated in FIG. 3, can be tipped over without liquid spilling out of the straw. Additionally, the crimp or crease at location 40 also prevents liquid 43 from squirting up through the straw 10 when container 35 is squeezed by the user.

Figure 4:
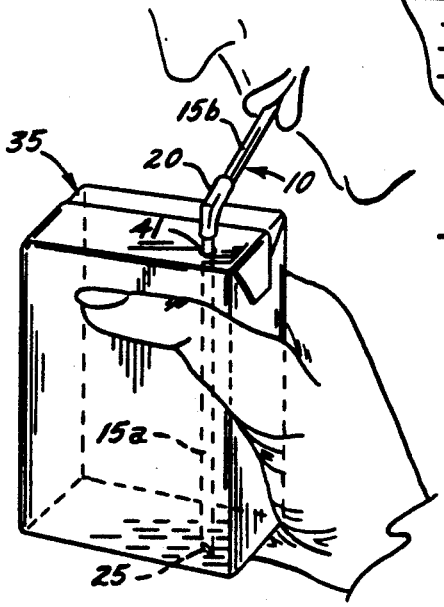
FIG. 4 is a perspective view of the container and straw shown in FIG. 3 with the straw being manually straightened by the user sufficiently to open the collapsed portion of the straw so that liquid can be drawn through the straw.

When provided in combination with a sealed container as illustrated in FIG. 2, the spill-resistant straw in any of its various embodiments is advantageously of a diameter substantially the same as the diameter of the drink container orifice. This is illustrated in FIG. 3 wherein it is seen that straw 10*a*, which is about the same diameter as orifice 41, sealingly engages orifice 41 In addition, as illustrated in FIG. 4, the predetermined bending location 40 is preferably provided at a location on the straw which is spaced from the beveled end 25 of the straw, at a distance greater than the distance between the seal 30 and the bottom wall 44 of the container. This preferred spacing allows the straw 10 to be inserted fully into the container with the bending location 40 and the biasing means 20 being located above orifice 41.

Figure 5:
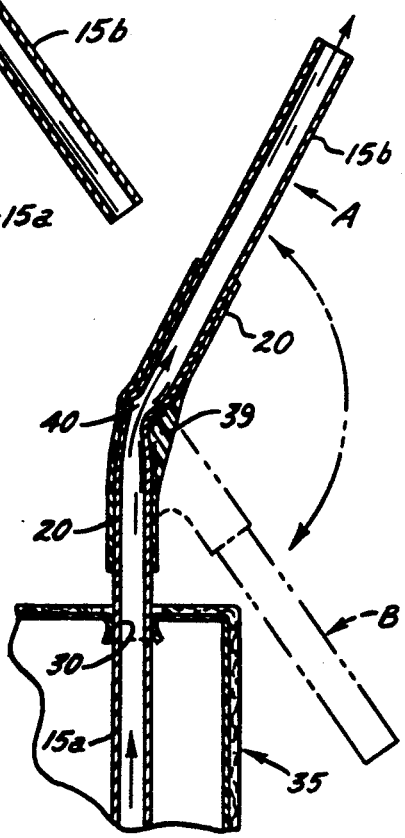
FIG. 5 is a cross-sectional view of the straw and container shown in FIG. 3 when the straw is in the open position together with a moved view in phantom showing the straw having been returned to its closed position.

Manual deformation of the spill-resistant straw 10 from its closed state to its open state is illustrated in FIGS. 4 and 5. When a user wishes to drink from the straw, the top segment 15*b* of the straw is manually moved, typically by the lips of the user, into a more straightened position. As best illustrated in FIG. 5, moving the straw to a more straightened position opens the crease at location 40 sufficiently that liquid can flow through the straw. With the straw in its open position A, flap 39 assumes the stretched position shown in FIG. 5. The inherent resiliency of the material used to form the biasing means 20 and thus, flap 39, automatically retracts the straw to its closed state B, illustrated in phantom, once external manual force is removed from the upper portion 15*b* of the spill-resistant straw 10.

Each time the user wishes to drink from the spill-resistant straw 10, the straw is manually deformed to its open state as discussed above. And each time manual force is released, the straw is returned by the biasing means 20 to its closed state. Accordingly, the material used to make the straw body, comprising segments 15*a* and 15*b*, is advantageously a resilient, preferably plastic, material, so that straw 10 can be repeatedly deformed to and from the open and closed states.

The spill-resistant straw 10 illustrated in FIGS. 1-5 can be manufactured in various ways. In one method, the axially bent, spill-resistant straws of the invention are manufactured by axially bending a tubular straw to collapse its walls at a predetermined bending location, and then treating the tubular straw while it is maintained in the axially bent condition, to provide a resilient bias in the tubular straw at the bending location so that the straw is resiliently biased in the bent and sealed state. For example, a conventional straw can be extruded from a polyolefin such as polypropylene in the normal manner and cut into straight straw lengths. The straw is then inserted into a rubber sleeve and the straw/rubber sleeve combination is bent at about the longitudinal mid-point of the rubber sleeve sufficiently to seal the interior of the straw. Typically, the amount of bending sufficient to seal the interior of the straw will be an amount sufficient to position the two straw segments 15*a* and 15*b*, which are located axially on either side of bending location 40, at an acute angle X with respect to each other as indicated in FIG. 1. While the straw is held in its bent position, the application of heat to the rubber sleeve causes the touching portions of the sleeve on the underside of the straw to melt together thereby forming integral flap 39.

Other methods for the provision of biasing means 20 will also be apparent. For example, a commercially available straight straw can be bent to substantially the position illustrated in FIG. 1 and at least the portion of the straw at and adjacent to the bending location 40 dipped into a liquid plastic which may be, for example, a latex, plastisol, molten plastic material, or the like. The straw is maintained in its bent position until the liquid plastic material has dried or hardened. The resultant dried or hardened plastic material then forms the biasing means 20 and holds the straw in its closed position as shown in FIGS. 1-3.

In another manufacturing method, a resilient member, such as sleeve 20, can be preformed in the biased, i.e., bent, configuration. The resilient member is then forced into a deformed and strained configuration, for example, by forcing the axially bent sleeve 20 into a straightened configuration. The resilient member is then attached to a drinking straw while the resilient member is maintained in the deformed and strained configuration. For example, a drinking straw is inserted into a resilient sleeve 20 while the sleeve is maintained in a straight, strained configuration. When the resilient member is then released from the deformed and strained configuration, it returns to its relaxed, i.e. bent, configuration, thereby resiliently urging the attached straw into the deformed configuration shown in FIG. 1.

Figure 6:
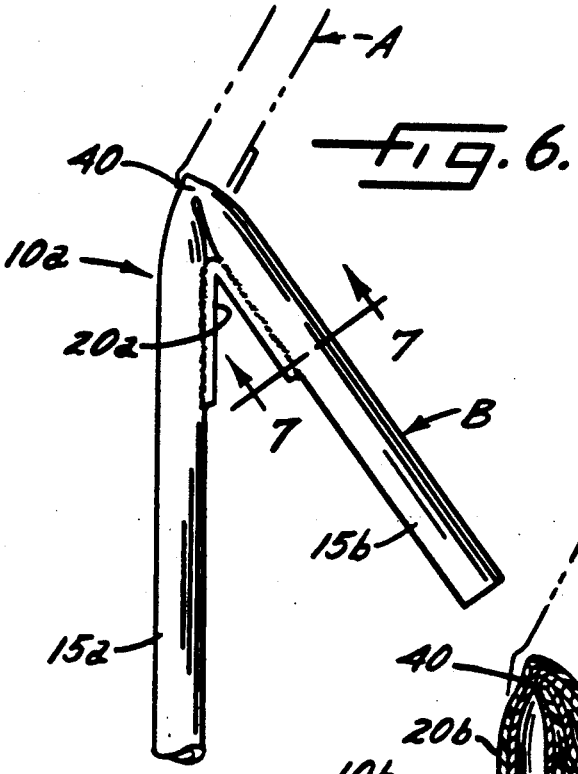
FIG. 6 illustrates another preferred spill-resistant straw of the invention wherein a biasing means in the form of a bent resilient plastic rod is attached to the underside of the straw.
Figure 7:
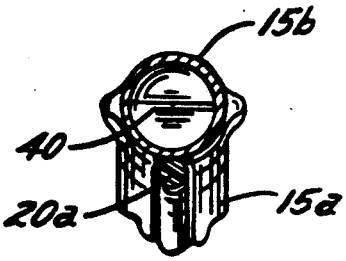
FIG. 7 is a partial cross-sectional view of the straw of FIG. 6 taken substantially along line 7—7.

FIGS. 6 and 7 illustrate another preferred spill-resistant straw 10*a* of the invention in which a bent resilient plastic rod 20*a*, is fixedly attached to the transverse underside of the straw 10*a* adjacent bending location 40. Axially bent rod 20*a* functions as the biasing means. The plastic rod 20*a* is advantageously formed of a flexible and resilient plastic material. The rod 20*a* once formed into the bent position, as for example, by injection molding or thermoforming of an initially straight rod, can manually be straightened; however, because of its resiliency, the rod 20*a* will return to the bent shape illustrated in FIG. 6. The rod 20*a* is attached to the underside of straw 10*a* by glue, by heating or in a similar manner either while bending the straw or while maintaining the rod 20*a* in a strained and straightened configuration to form the spill resistant straw as shown in FIGS. 6 and 7 and thereby biases the straw into its bent and substantially sealed state. The straw can be deformed manually to a more straightened position A, shown in phantom, for use in drinking. Upon removal of the manual force, the bent plastic rod automatically returns the straw to its bent position, B, thus forming a crease in the straw at location 40 and substantially sealing the interior of the straw.

Figure 8:
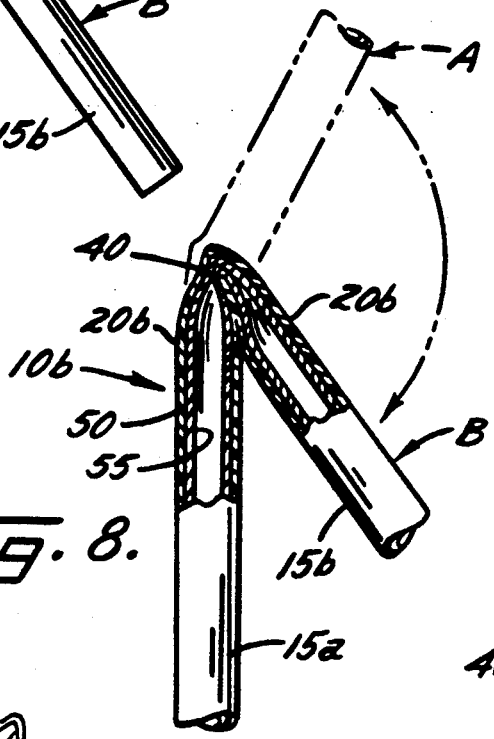
FIG. 8 is a fragmentary cross-sectional view of another preferred spill-resistant straw of the invention in which the biasing means is integrally provided in the straw via coextruded layers of different plastics in the straw.

FIG. 8 is a fragmentary cross-sectional view of another preferred embodiment of the invention in which a biasing means 20*b* is integrally formed within the straw 10*b*. As shown in FIG. 8, straw 10*b* comprises coaxial plastic layers including an exterior layer 50 and an interior layer 55. The plural layer straw can be formed by, for example, co-extrusion processes as are known to those skilled in the art or by an in-line coating process wherein an extruded single layer tube is coated with an exterior plastic layer by any of various known processes.

Advantageously, the plastic material which forms exterior layer 50 of straw **10*b* has a lower melting point than the plastic material forming interior layer 55 of the straw. Accordingly, the multiple layer straw can initially be formed in a straight shape and thereafter bent and thermally set into the bent position illustrated in FIG. 8 whereby the interior of the straw is mechanically sealed at crease 40. Since the interior layer 55 of the straw has a higher melting point than the exterior layer 50, the exterior layer can be thermally set into the desired shape without melting and subsequent fusion of the interior layer 55 at location 40. Advantageously, the interior layer 55 is formed of a plastic material having a high stiffness and resiliency so that when the composite straw is manually moved into the straightened position A, interior layer 55 of the tube resiliently forces the interior portion of the straw at bending location 40** into an open state.

Any of various combinations of plastic material can be employed to form the composite straw illustrated in FIG. 8. Thus, for example, exterior layer 55 can be formed from a polyethylene or a polyethylene copolymer or terpolymer composition while interior layer 15 is formed from polypropylene or from high density polyethylene or a linear low density polyethylene. Similarly, exterior layer 50 can be formed of a polyolefin such as polyethylene or polypropylene with interior layer 55 being formed of a different class of high melting polymers such as a polyester, e.g. polyethylene terephthalate. In still another alternative, exterior layer 50 can be formed of a resilient polyester such as polybutylene terephthalate with the interior layer 55 being formed from a stiffer and higher melting point polyester such as polyethylene terephthalate.

It will also be apparent that resilient sleeve 20 of FIGS. 1–5 and/or resilient rod **20*a* of FIGS. 6–7 can be integrally formed with straws 10 and 10*a*, respectively, by any of various plastic processing techniques known to those skilled in the art. For example, sleeve 20 of FIGS. 1–5 can be integrally formed with straw 10, during the straw forming extrusion process, as an exterior layer along the entire length of the straw or along a portion of the length of the straw at a predetermined location. Similarly, rod 20*a* of FIGS. 6–7 can be integrally formed with straw 10*a* during the extrusion process as either a portion of the straw wall or as a linear bead longitudinally extending along the straw wall. In either case, sleeve 20 or rod 20*a* will advantageously be formed of a plastic material having a lower melting point than the material forming the main body of straw 10 or 10*a*, so that the straw can be thermally formed into the desired bent position without melting of the main body of the straw 10 or 10*a***.

Figure 9:
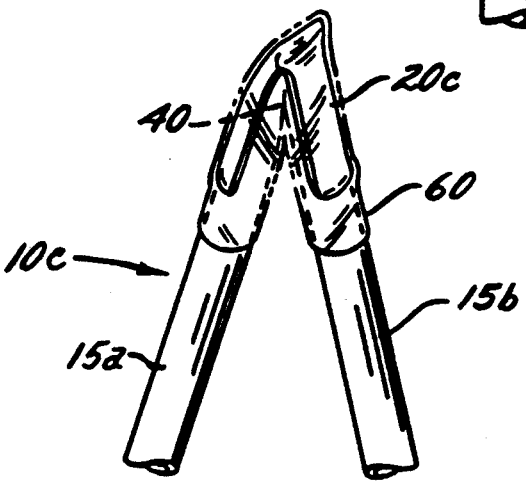
FIG. 9 is a perspective view of another preferred spill-resistant straw according to the invention in which the biasing means in the form of a resilient folded plastic member is provided on the top side of the straw.
Figure 10:
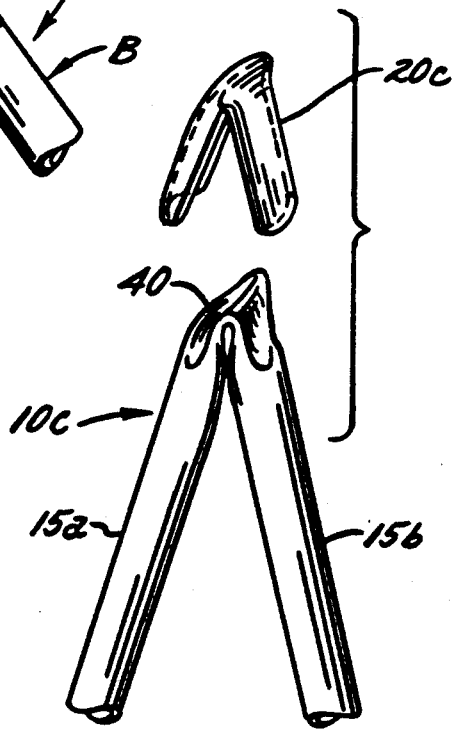
FIG. 10 is an exploded view of the spill-resistant straw shown in FIG. 9.

FIGS. 9 and 10 illustrate yet another preferred embodiment of the invention in which a bent elongated body member **20*c* is fixedly attached to straw 10*c* at bend location 40 on the transverse top side of the straw. Body member 20*c* is advantageously of arcuate cross section so that it conforms to the exterior contour of straw 10*c*. As illustrated in FIG. 9, body member 20*c* is attached to straw 10*c* by means of a tubular shrink wrap 60. Body member 20*a* is advantageously composed of a flexible and resilient plastic material so that straw 10*c* is normally biased in the bent position. The body member is sufficiently flexible about its fold so that the combination of straw 10*c* and body member 20 can be readily deformed manually into a more straightened open position (not shown). The release of external manual force results in the retraction of body member 20*c* to its bent position which, in turn, retracts the straw portions 15*a* and 15*b* into the bent and substantially sealed state. During assembly, body member 20*c* can be provided in combination with shrink wrap 60, in a straightened or bent form. A conventional straw is then threaded through the shrink wrap 60. The application of heat to the shrink wrap fixedly attaches the body member 20*c* to the straw 10*c*. If the body member was provided initially in straight form, the body member is then thermally set into its axially bent position. On the other hand, if the body member 20*c* is initially provided in bent form, the application of heat to the shrink wrap 60 will shrink the tubular shrink wrap 60 causing the straw to conform to the axially bent shape of body member 20*c***.

Figure 11:
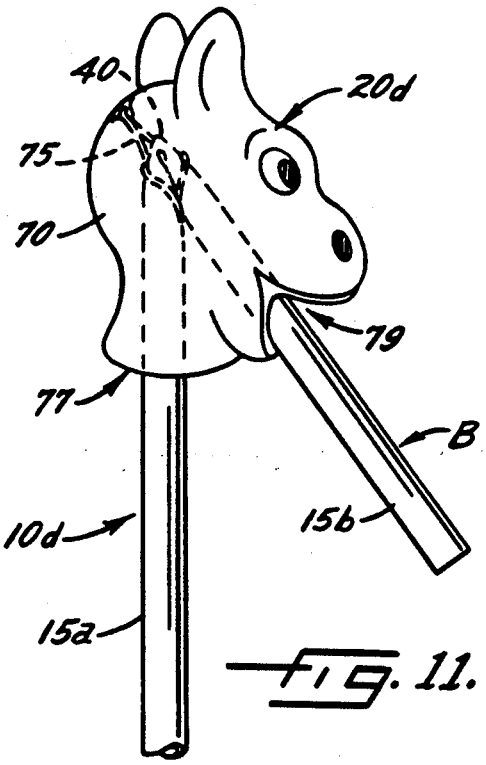
FIG. 11 is a perspective view of another preferred spill-resistant straw embodiment of the invention in which a toy animal head is provided as a portion of the biasing means for retracting the straw to its closed position.
Figure 12:
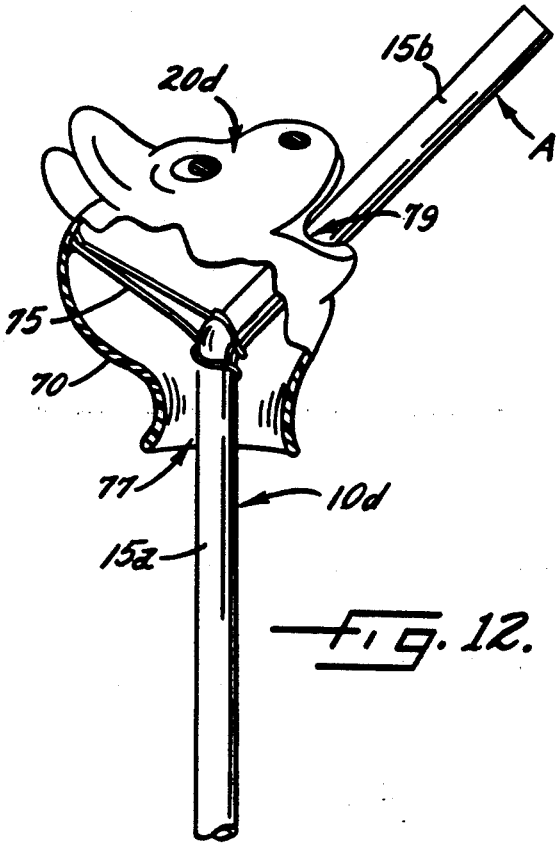
FIG. 12 is a view in partial cutaway showing the spill-resistant straw of FIG. 11 in its open position.

FIGS. 11 and 12 illustrate yet another embodiment of the invention wherein the biasing means **20*d* comprises a dual orifice hollow plastic member, in the shape of a toy head 70, combined with an elongated resilient member 75 which may be, for example, a rubber band of the desired size. In this embodiment, straw 10*d* is threaded through the neck orifice 77 and the mouth orifice 79, each of which are located in a lower portion of the hollow body or toy head 70 so that the lower portion, 15*a*, of straw 10*d* extends from the neck orifice 77 and upper portion 15*b* of straw 10*d* extends from the mouth orifice 79. The elongated resilient member 75 is attached to an upper interior portion of the toy head 70 and at a predetermined position 40 along the length of the straw 10*d*, which is located within hollow body 70 and between the two orifices. The elongated resilient member 75, when relaxed, cooperates with orifices 77 and 79 to bias the straw into the bent or folded position B as illustrated in FIG. 11. The biasing means 20*d*** thus maintain the straw in its substantially sealed state in the absence of external force.

The straw **10*d* can be straightened into an opened state, A, as illustrated in FIG. 12 by the application of manual force. This, in turn, stretches elastic member 75 so that upon release of the manual force the straw is automatically returned to the bent and substantially sealed position B as shown in FIG. 11**.

Figure 13:
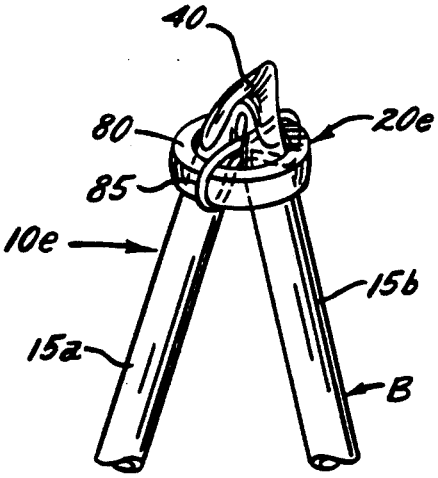
FIG. 13 is a perspective view of still another spill-resistant straw according to the invention in which a toy ring or the like is employed as a portion of the means for biasing and retracting the straw in a closed position.
Figure 14:
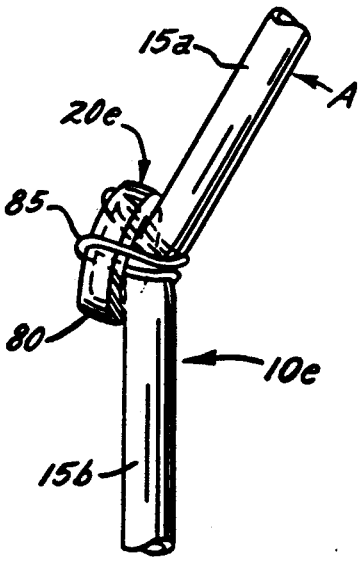
FIG. 14 is a perspective view of the spill-resistant straw of FIG. 13, shown in its open position.

FIGS. 13 and 14 illustrate an embodiment of the invention in which the biasing means **20*e* comprises the combination of a substantially rigid ring 80 together with a resilient band 85 which extends transversely across the exterior of ring 80. As illustrated in FIG. 13, straw 10*e* is threaded upwardly through ring 80 and is then folded across resilient band 85, and is then threaded back downwardly through the ring 80 on the other side of resilient band 85. The interior of annular ring 80 is thus divided into two semicircular portions by means of resilient band 85 with the portions 15*a* and 15*b* of straw each passing through a different one of the two separate portions of the interior surface of the annular ring. The ring and resilient band 85 cooperate to maintain straw 10*e* in its bent position B illustrated in FIG. 13. The straw 10*e* can be straightened to an open position A, shown in FIG. 14 by the application of manual force. This, in turn, stretches resilient ring 85** which resilient urges the straw back to its bent and substantially sealed state when the manual force is released.

FIGS. 15–18 illustrate still another embodiment of the invention in which an integral biasing means 20*f* is formed by an arcuate portion of the body of tubular straw 15. The spill-resistant drinking straw 10*f* shown in FIG. 15 has an open mouth end 90 and a sealed, beveled bottom 92, best shown in FIG. 16. The beveled bottom terminates in a point 95 on one side of straw 10*f*. There is a transverse partial cut 97 extending through a major portion of the body of straw 10*e* at a location axially above the sealed bottom 92 and in the bottom half of the straw 10*f*. A minor arcuate portion 20*f* of the body of straw 10*f* remains uncut thereby connecting portions 15*a* and 15*b* and functions to maintain the body of straw 10*e* in a straightened condition and, in turn, maintains cut 97 in a closed state. Straw body portion 20*f* thus maintains the straw in a substantially sealed state since liquid cannot enter into the straw through its sealed end 92 or through the closed cut 97.

Figure 15:
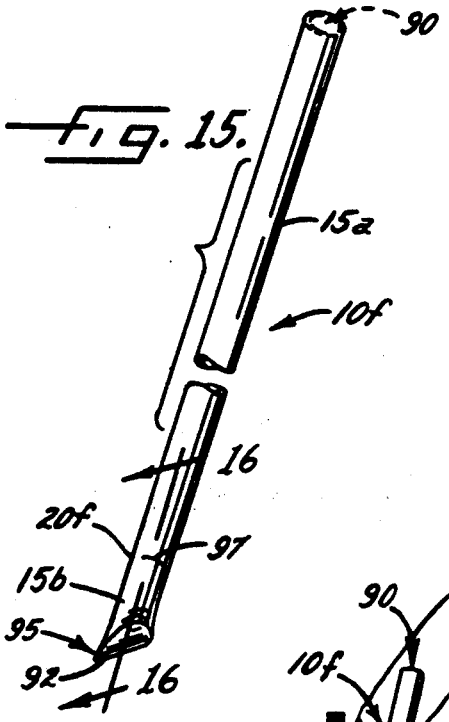
FIG. 15 is a perspective view of yet another preferred spill-resistant drinking straw according to the invention.
Figure 16:
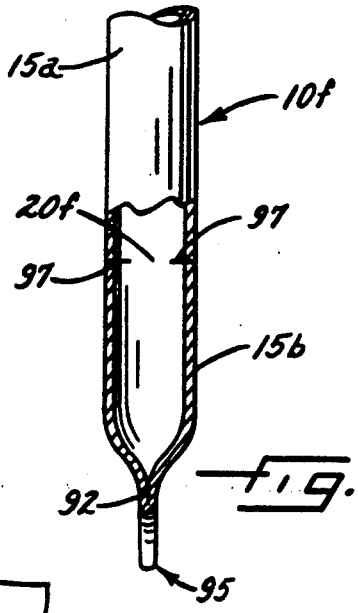
FIG. 16 is a partial cross-sectional view of the straw of FIG. 15, taken substantially along line 16—16.
Figure 17:
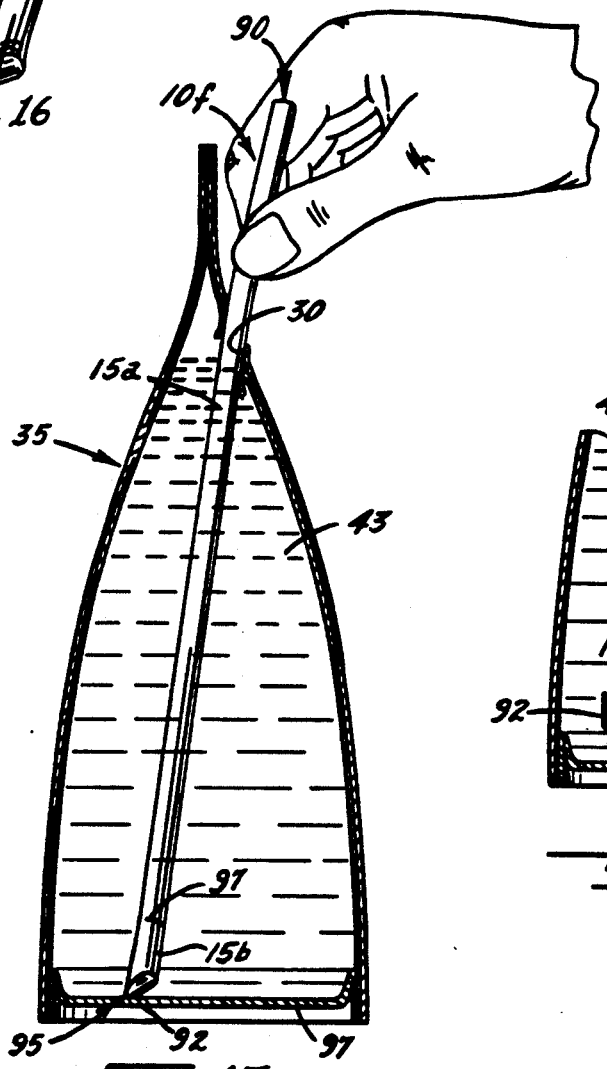
FIG. 17 is a partial perspective view of the straw of FIGS. 15 and 16 shown inserted into a liquid container.
Figure 18:
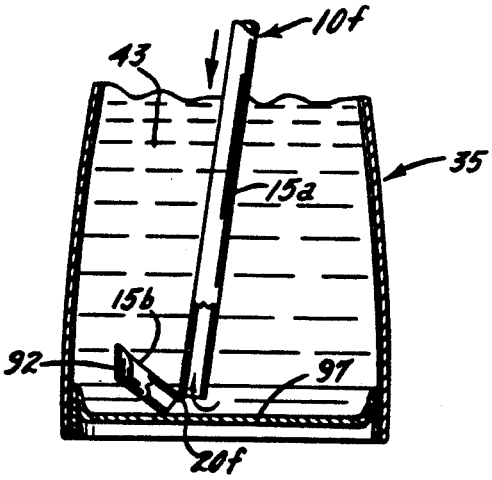
FIG. 18 is a fragmentary cross-sectional view of the spill-resistant straw and container shown in FIG. 17, with the straw being manually deformed to its opened state.

FIGS. 17 and 18 illustrate the use of the spill-resistant straw 10*e* shown in FIGS. 15 and 16. With reference to FIG. 17, the straw is inserted through a seal 30 of a flexible package 35. The point 95 on the bottom of straw 15 assists in puncturing the seal 30 of the container 35. Since the straw is substantially sealed as it is inserted into the container 35, liquid 43 in the container is substantially precluded from squirting up through the straw during the insertion operation.

As shown in FIG. 17, the straw is inserted into the container until the bottom point 95 of the straw contacts the bottom wall 97 of the container. The application of further downward pressure on the straw as illustrated in FIG. 18, causes the lower portion 15*a* of the straw below cut 97, to bend at a location axially coincident the partial cut. The uncut portion 20*f* of the straw which is axially coincident the partial cut, acts as a resilient hinge. This in turn opens cut 97 allowing liquid to enter into the straw through the opening defined by the cut. Because the body of the straw 10*e* is comprised of a relatively stiff but flexible plastic material, such as polypropylene, the uncut portion 20*f* of the straw body resiliently urges the straw body back into a straightened position upon the release of the manual downward force on the straw. This in turn closes cut thereby substantially sealing the straw. Although not specifically shown in the drawings, in another embodiment of the invention a resilient reinforcement can be provided at or adjacent the uncut portion 20*f* of the tubular straw 10*f* in order to enhance the biasing and retracting function of body portion 20*f*.

The invention thus provides spill-resistant and squirt-resistant straws which can be used with any of various well known containers in order to prevent or minimize spilling of liquids. The spill-resistant straws provided by the invention can be readily and inexpensively manufactured according to any of various well known plastic manufacturing processes. The straws of the invention are readily manufacturable from commercially available straws by attachment of a biasing means to any of various commercially available straws or can be manufactured to include an integral biasing means. The straws of the invention are simple to use and can be substituted for conventional straws in any of the various known uses thereof. Nevertheless, the spill-resistant straws according to the invention reliably prevent accidental squirting and spillage of liquids through the straw.

The invention has been described in considerable detail with specific reference to various preferred embodiments thereof. However, variations and modifications can be made without departing from the spirit and scope of the invention as described in the foregoing specification and defined in the appended claims.

That which is claimed is:

1. A spill-resistant drinking straw comprising:

(a) a tubular straw which is deformable repeatedly to and from a substantially sealed state in which liquid is substantially prevented from flowing through the straw and an open state in which liquid can readily flow through the straw; and (b) a biasing means for biasing the tubular straw in the substantially sealed state and for retracting the tubular straw from the open state to the sealed state;

the tubular straw being manually deformable to the open state for use in drinking and returned to the sealed state by the biasing means in the absence of external force.

2. The spill-resistant drinking straw of claim 1 wherein the biasing means is attached at a predetermined location along the length of the tubular straw.

3. The spill-resistant drinking straw of claim 1 wherein the biasing means is integrally formed in the tubular straw.

4. The spill-resistant drinking straw of claim 1 wherein the tubular straw is repeatedly bendable at a predetermined bending location along the longitudinal axis, to and from the substantially sealed state and the open state.

5. The spill-resistant drinking straw of claim 4 wherein, in the substantially sealed state, the straw is bent axially sufficiently to collapse the straw at the bending location.

6. The spill-resistant drinking straw of claim 5 wherein the biasing means is attached to at least a portion of the tubular straw at or adjacent the bending location.

7. The spill-resistant drinking straw of claim 5 wherein the biasing means is integrally formed in the tubular straw.

8. The spill-resistant drinking straw of claim 5 wherein the biasing means comprises a resilient member attached to at least a portion of the tubular straw which is axially coincident with and on a transverse underside portion at the bending location.

9. The spill-resistant drinking straw of claim 5 wherein the biasing means comprises a resilient member attached to at least a portion of the tubular straw which is axially coincident with, a transverse upper side portion at the bending location.

10. The spill-resistant drinking straw of claim 5 wherein the biasing means comprises a resilient sleeve member surrounding at least an axial portion of the tubular straw coincident with the bending location.

11. The spill-resistant drinking straw of claim 5 wherein the tubular straw comprises at least two coaxial plastic layers and wherein at least one of the coaxial plastic layers is thermally formed into a bent condition thereby providing the biasing means integrally within the tubular straw.

12. A spill-resistant drinking straw comprising:

(a) a resilient tubular straw; and (b) a biasing means provided at a predetermined location along the length of the tubular straw for resiliently biasing the tubular straw in an axially bent position such that the tubular straw is crimped at a predetermined bending location sufficiently to substantially seal the tubular straw such that liquid is substantially prevented from flowing through the straw;

the tubular straw being manually bendable out of the axially bent position to an opened state in which liquid can readily flow through the straw for use in drinking and returned to the axially bent position by the biasing means in the absence in external force.

13. The spill-resistant drinking straw of claim 12 wherein the tubular straw is made of a plastic material.

14. The spill-resistant drinking straw of claim 12 wherein the biasing means is integrally provided within at least a portion of the tubular straw.

15. The spill-resistant drinking straw of claim 12 wherein the biasing means is attached to at least a portion of the tubular straw at the predetermined location.

16. The spill-resistant drinking straw of claim 12 wherein in the axially bent position, opposed portions of the tubular straw on opposed axial sides of the bending location, form an acute angle with each other.

17. The spill-resistant drinking straw of claim 12 wherein the biasing means comprises a resilient member attached to at least a portion of the tubular straw which is axially coincident with and on a transverse underside portion at the predetermined location.

18. The spill-resistant drinking straw of claim 12 wherein the biasing means comprises a resilient member attached to at least a portion of the tubular straw which is axially coincident with, and on a transverse upper side portion at the predetermined location.

19. The spill-resistant drinking straw of claim 12 wherein the biasing means comprises a resilient sleeve member surrounding at least an axial portion of the tubular straw coincident with the predetermined location.

20. The spill-resistant drinking straw of claim 12 wherein the tubular straw comprises at least two coaxial plastic layers and wherein at least one of the coaxial plastic layers is thermally formed into a bent condition thereby providing the biasing means integrally within the tubular straw.

21. The spill-resistant drinking straw of claim 12 wherein the biasing means comprises a hollow body having at least two orifices in a lower portion thereof and wherein an elongated resilient member is attached to the hollow body at an upper portion thereof; the tubular straw being passed through each of the two orifices so that the bending location on the tubular straw is positioned inside the hollow body; and the elongated resilient member being attached to the tubular straw at or adjacent the predetermined location.

22. The spill-resistant drinking straw of claim 12 wherein the biasing means comprises an annular ring and a resilient band attached to the annular ring and extending transversely across the interior defined by the annular ring to thereby separate the interior of the annular ring into at least two semicircular portions, the tubular straw being passed through each of the two separated interior portions of the ring and across the resilient band, so that the annular ring and the resilient band cooperatively bias the tubular straw into the axially bent position.

23. A spill-resistant drink product comprising:

(a) a sealed container containing a liquid, the container comprising a puncturable seal in a top portion thereof, the puncturable seal being adapted to provide an orifice of substantially predetermined diameter;

(b) a spill-resistant drinking straw removably attached to the sealed container, the spill-resistant drinking straw comprising a tubular straw having a diameter substantially the same as the diameter of the orifice, the tubular straw being repeatedly deformable to and from a substantially sealed state and an open state; the spill-resistant drinking straw additionally comprising a biasing means for biasing the tubular straw in the substantially sealed state and for retracting the tubular straw from the open state to the sealed state.

24. The spill-resistant drink product of claim 23 wherein the tubular straw is repeatedly bendable at a predetermined bending location along the longitudinal axis, to and from the substantially sealed state and the open state.

25. The spill-resistant drink product of claim 24 wherein at least one end of the tubular straw is beveled.

26. The spill-resistant drink product of claim 25 wherein the sealed container is defined in part by a bottom wall; and wherein the axial distance between the beveled end of the tubular straw and the predetermined bending location on the tubular straw is greater than the distance between the bottom wall of the container and the puncturable seal in the top portion of the container.

27. The spill-resistant drink product of claim 26 wherein the biasing means is integrally formed in the tubular straw.

* * * * *